US008910933B2

(12) United States Patent
Shin

(10) Patent No.: US 8,910,933 B2
(45) Date of Patent: Dec. 16, 2014

(54) IMAGE FORMING APPARATUS

(71) Applicant: Samsung Electronics Co., Ltd., Suwon-si (KR)

(72) Inventor: Dong-hyup Shin, Seongnam (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 13/665,050

(22) Filed: Oct. 31, 2012

(65) Prior Publication Data

US 2013/0154184 A1 Jun. 20, 2013

(30) Foreign Application Priority Data

Dec. 14, 2011 (KR) ..... 10-2011-0134463

(51) Int. Cl.
*B65H 1/26* (2006.01)

(52) U.S. Cl.
USPC ..... 271/157; 271/160; 271/147

(58) Field of Classification Search
USPC ..... 271/147, 157, 160, 162
See application file for complete search history.

(56) References Cited

U.S. PATENT DOCUMENTS 4,793,606 A * 12/1988 Yasuoka et al. ..... 271/157
4,813,612 A * 3/1989 Kano et al. ..... 271/10.11
5,228,676 A * 7/1993 Arai et al. ..... 271/117
5,564,690 A * 10/1996 Oshida ..... 271/157
6,106,178 A 8/2000 Chiu
7,448,613 B2 * 11/2008 Takahashi ..... 271/157
2007/0200284 A1 8/2007 Takahashi
2011/0140341 A1 * 6/2011 Nishikata et al. ..... 271/3.09
2012/0126475 A1 5/2012 Shin et al.

FOREIGN PATENT DOCUMENTS

EP 0 575 996 12/1993
GB 2 147 278 5/1985
JP 55151445 A * 11/1980
KR 10-2012-0053580 5/2012

OTHER PUBLICATIONS

European Search Report mailed Aug. 29, 2013 is corresponding European Application No. 12182392.6.

* cited by examiner

*Primary Examiner* — Ernesto Suarez
(74) *Attorney, Agent, or Firm* — Staas & Halsey LLP

(57) ABSTRACT

An image forming apparatus includes a main body including a printing unit for printing an image on a recording medium and a pickup roller for picking up the recording medium, a paper feeding device, which includes an elevatable knock-up plate on which recording media are stackable and a pressure member for elastically pressing the knock-up plate towards the pickup roller and is removably inserted into the main body, and a variable guide unit, which is supported by the main body, is fixed in a slope state to lower the knock-up plate in a direction against the pickup roller when the paper feeding device is withdrawn from the main body, and moves to maintain a contact state with the knock-up plate due to a rising state of the knock-up plate in a state in which the paper feeding device is inserted into the main body.

9 Claims, 9 Drawing Sheets

IMAGE FORMING APPARATUS

CROSS-REFERENCE TO RELATED APPLICATIONS

This application claims the priority benefit of Korean Patent Application No. 10-2011-0134463, filed on Dec. 14, 2011, in the Korean Intellectual Property Office, the disclosure of which is incorporated herein in its entirety by reference.

BACKGROUND

1. Field

One or more embodiments of the present disclosure relate to an image forming apparatus, and more particularly, to an image forming apparatus with an improved paper feeding device for feeding a recording medium.

2. Description of the Related Art

Image forming apparatuses are generally used to form an image on a recording medium. Examples thereof include printers, copy machines, facsimile machines, and all-in-one devices implemented by combining functions of a printer, a copy machine, and a facsimile machine.

Such image forming apparatuses generally include a paper feeding device for feeding a recording medium to a printing unit included in the image forming apparatus. The recording medium accommodated in the paper feeding device is picked up by a pickup roller and fed to the printing unit along a predetermined path. The pickup roller picks up the recording medium by using a frictional force against the recording medium. A frictional force sufficient for the pick-up requires a predetermined pressure relationship between the recording medium and the pickup roller. For the predetermined pressure relationship, a knock-up plate for pressing the recording medium against the pickup roller is used.

However, because the knock-up plate presses the recording medium against the pickup roller even when the paper feeding device is withdrawn, a so-called jamming phenomenon occurs in which a portion of the recording medium is jammed because the recording medium remains due to the frictional force between the recording medium and the pickup roller, thereby resulting in faulty printing.

To solve this problem, a method of releasing the pressure relationship between a recording medium and the pickup roller by lowering the knock-up plate when the paper feeding device is withdrawn has been proposed.

Conventionally, by fixedly assembling a guide unit for guiding the knock-up plate to be lowered in a main body to lower the knock-up plate assembled with the paper feeding device along the fixed guide unit when the paper feeding device is withdrawn according to the method, a pressure relationship between the recording medium and the pickup roller can be released.

However, because the guide unit has a fixed structure and provides a constant slope regardless of the remaining number of recording media accommodated in the paper feeding device, a gap between the guide unit and the knock-up plate varies according to the remaining number of recording media. In particular, when the remaining number of recording media is large, the gap between the guide unit and the knock-up plate is very large, and thus, the knock-up plate cannot be immediately lowered even when the paper feeding device is withdrawn and the pressure relationship is temporarily maintained, thereby resulting in a jam.

SUMMARY

One or more embodiments of the present disclosure relate to an image forming apparatus capable of preventing a jam in a withdrawal of a paper feeding device regardless of the remaining number of recording media.

Additional aspects and/or advantages will be set forth in part in the description which follows and, in part, will be apparent from the description, or may be learned by practice of the embodiments described.

According to an aspect of the present disclosure, there is provided an image forming apparatus including: a main body including a printing unit for printing an image on a recording medium and a pickup roller for picking up the recording medium; a paper feeding device, which includes an elevatable knock-up plate on which recording media are stackable and a pressure member for elastically pressing the knock-up plate towards the pickup roller and is removably inserted into the main body; and a variable guide unit, which is supported by the main body, is fixed in a slope state to lower the knock-up plate in a direction against the pickup roller when the paper feeding device is withdrawn from the main body, and moves to maintain a contact state with the knock-up plate due to a rising state of the knock-up plate in a state in which the paper feeding device is inserted into the main body.

The variable guide unit may include: a variable guide member, which has a slope unit downwardly sloped in a withdrawal direction to lower the knock-up plate in a direction against the pickup roller by contacting with a contact unit of the knock-up plate when the paper feeding device is withdrawn from the main body and is supported by the main body for the slope unit to maintain a contact state with the contact unit due to a rising state of the knock-up plate; and a fixing member, which is supported by the main body, moves to a fixing position for fixing the variable guide member to be coupled with the variable guide member when the paper feeding device is withdrawn from the main body, and moves to a release position for releasing the variable guide member to be decoupled from the variable guide member when the paper feeding device is inserted into the main body.

The slope unit may include a release unit for allowing the contact unit to be released from the slope unit after the knock-up plate is lowered.

The contact unit may be formed to protrude from the knock-up plate, and the release unit may be formed as a groove in the slope unit so that the contact unit passes through the release unit.

The image forming apparatus may further include a first elastic member for providing an elastic force to the variable guide member in a direction in which the slope unit contacts the contact unit.

The elastic force of the first elastic member may be less than a pressure of the pressure member.

The image forming apparatus may further include: a second elastic member for providing an elastic force in a direction in which the fixing member moves to the fixing position; and a switching member for switching to the release position in contact with the fixing member when the paper feeding device is inserted into the main body.

The switching member may maintain the fixing member at the release position by maintaining a contact state with the fixing member in a state in which the insertion of the paper feeding device is completed.

The variable guide unit may include a first coupling unit, and the fixing member may include a second coupling unit having a shape complementary to the first coupling unit, the second coupling unit being coupled with the first coupling unit when the fixing member is located at the fixing position.

The first and second coupling units may have gear shapes gearing with each other.

BRIEF DESCRIPTION OF THE DRAWINGS

The above and other features and advantages of the present disclosure will become more apparent by describing in detail exemplary embodiments thereof with reference to the attached drawings in which.

DETAILED DESCRIPTION

One or more embodiments of the present disclosure will now be described more fully with reference to the accompanying drawings, in which exemplary embodiments are shown.

Figure 1:
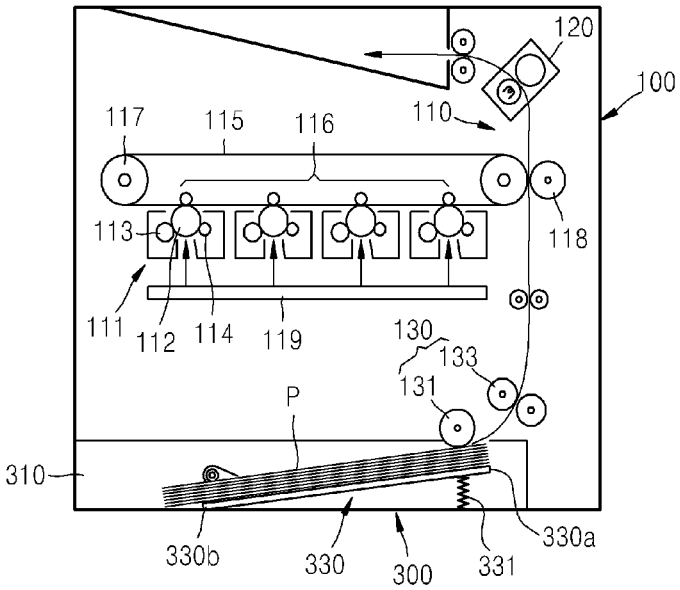
FIG. 1 is a schematic configuration of an image forming apparatus according to an embodiment of the present disclosure.

FIG. 1 is a schematic configuration of an image forming apparatus according to an embodiment of the present disclosure.

As shown in FIG. 1, the image forming apparatus may include, for example, a main body 100 and a paper feeding device 300.

Figure 2:
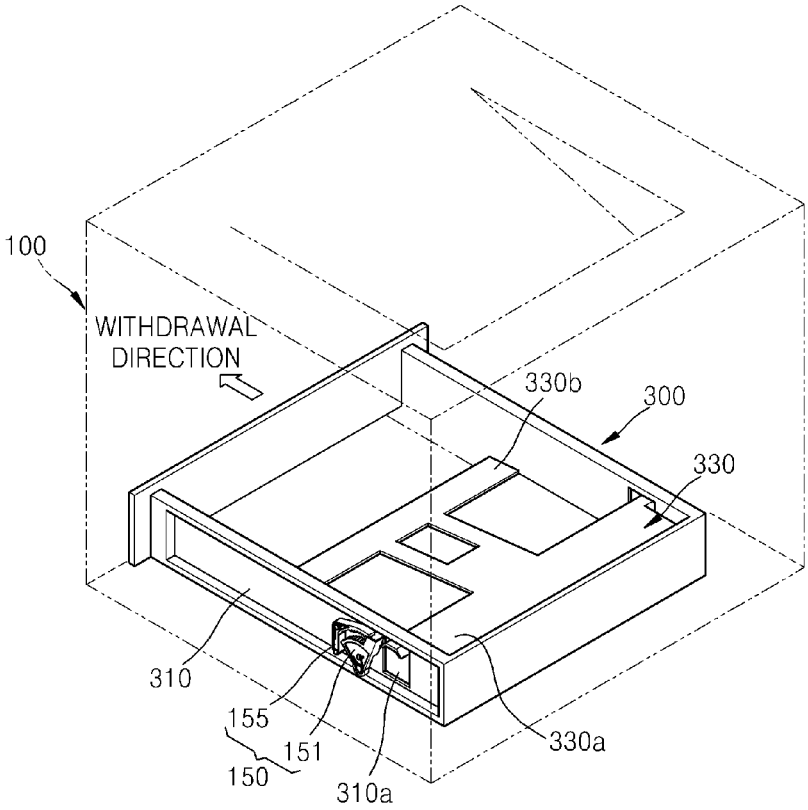
FIG. 2 is a perspective view showing a state in which a paper feeding device is inserted into a main body in the image forming apparatus according to an embodiment of the present disclosure.

The main body 100 may include, for example, a printing unit 110, a pickup unit 130, and a variable guide unit such as variable guide unit 150 of FIG. 2.

The printing unit 110 may form an image on a recording medium P. In detail, the printing unit 110 forms an image on the recording medium P by electrophotography. The printing unit 110 may include developers 111, an intermediate transfer belt 115, an intermediate transfer roller 116, a final transfer roller 118, a light-exposure unit 119, and a fuser 120. The printing unit 110 forms a color image by using cyan-, magenta-, yellow-, and black-colored toners. To do this, four developers 111 for accommodating the cyan-, magenta-, yellow-, and black-colored toners, respectively, are used.

The light-exposure unit 119 forms a static latent image by radiating light modulated in correspondence with image information onto a photosensitive drum 112 of each of the developers 111. The light-exposure unit 119 may employ a Light Emitting Diode (LED) light-exposure unit in which a plurality of LEDs arranged in a main scanning direction selectively emit light. Alternatively, the light-exposure unit 119 may employ a Laser Scanning Unit (LSU) for deflecting light radiated from a laser diode in the main scanning direction by using a light deflector and radiating the deflected light onto the photosensitive drum 112.

The photosensitive drum 112 is an example of a photosensitive body on which a static latent image is formed. The photosensitive drum 112 may be formed by forming a photosensitive layer having light conductivity around a cylindrical metal pipe.

The developer 111 forms a toner image by attaching a toner accommodated therein to the static latent image formed on the photosensitive drum 112. The developer 111 may include a developing roller 113 for supplying the toner accommodated in the developer 111 to the static latent image formed on the photosensitive drum 112 and an electrifying roller 114 for electrifying the surface of the photosensitive drum 112 with a uniform potential.

A developing bias voltage for supplying a toner to a static latent image is applied to the developing roller 113, and an electrifying bias voltage is applied to the electrifying roller 114. Here, a corona electrifying unit (not shown) may be employed instead of the electrifying roller 114.

The intermediate transfer belt 115 is an intermediate transfer medium to which the toner image is temporarily transferred before the toner image is finally transferred to the recording medium P, and that is supported by supporting rollers 117 to be able to circulate.

The intermediate transfer roller 116 is an example of an intermediate transfer member for transferring the toner image formed on the photosensitive drum 112 to the intermediate transfer belt 115. Four intermediate transfer rollers 116 face four photosensitive drums 112, respectively, with the intermediate transfer belt 115 therebetween. An intermediate transfer bias voltage for transferring the toner image formed on the photosensitive drum 112 to the intermediate transfer belt 115 is applied to the intermediate transfer roller 116. The cyan-, magenta-, yellow-, and black-colored toner images formed on the four photosensitive drums 112 in the four developers 111, respectively, are transferred to the intermediate transfer belt 115 by an intermediate transfer electric field formed by the intermediate transfer bias voltage.

The final transfer roller 118 is an example of a final transfer unit for transferring the toner image on the intermediate transfer belt 115 to the recording medium P. A final transfer bias voltage for transferring the toner image on the intermediate transfer belt 115 to the recording medium P is applied to the final transfer roller 118. A corona transfer unit (not shown) may be employed instead of the final transfer roller 118. While the recording medium P is travelling between the intermediate transfer belt 115 and the final transfer roller 118, the toner image on the intermediate transfer belt 115 is transferred to the recording medium P by a final transfer electric field formed by the final transfer bias voltage.

The fuser 120 fixes the toner image to the recording medium P by providing heat and pressure to the toner image transferred to the recording medium P. The recording medium P, which has undergone the fixing process, is discharged from the main body 100. The pickup unit 130 picks up the recording medium P accommodated in the paper feeding device 300 and feeds the recording medium P to the printing unit 110. The pickup unit 130 may include a pickup roller 131 for directly contacting with and picking up the recording medium P accommodated in the paper feeding device 300 and a feed roller 133 for feeding the recording medium P picked up by the pickup roller 131 to the printing unit 110.

The paper feeding device 300 accommodates the recording medium P on which an image is formed and is removably inserted into the main body 100.

The paper feeding device 300 includes a paper feeding cassette 310 for accommodating the recording medium P. The paper feeding cassette 310 includes a knock-up plate 330. The recording media P are stacked on the knock-up plate 330. The knock-up plate 330 rises against the pickup roller 131 to contact the stacked recording medium P with the pickup roller 131.

Referring now to FIG. 2, the variable guide unit 150 may act as a guide to release a pressure relationship between the pickup roller 131 and the recording medium P when the paper feeding device 300 is withdrawn from the main body 100, as described below.

In an embodiment, the knock-up plate 330 may be rotatably assembled with the paper feeding cassette 310. The knock-up plate 330 may be assembled with the paper feeding cassette 310 by a hinge axis included in a rear end 330*b* of the knock-up plate 330, thereby making a front end 330*a* of the knock-up plate 330 rise upwards or lower downwards according to the number of stacked recording media P. That is, the front end 330*a* of the knock-up plate 330 rise upwards towards the pickup roller 131 or lowers downwards away from the pickup roller 131 according to the number of stacked recording media P. The knock-up plate 330 may be elastically pressed in a direction of the pickup roller 131, that is, towards the pickup roller 131, by a pressure member 331. The pressure member 331 may be, for example, a compression coil spring interposed between the knock-up plate 330 and the paper feeding cassette 310, however, the scope of the present disclosure is not limited thereto. The pressure member 331 may employ various members capable of pressing the knock-up plate 330 towards the pickup roller 131. When the remaining number of recording media P accommodated in the paper feeding cassette 310 is small, the knock-up plate 330 rises to be nearer to the pickup roller 131 due to the elastic force of the pressure member 331, and when the remaining number of recording media P accommodated in the paper feeding cassette 310 is large, the knock-up plate 330 lowers in a direction opposing the elastic force of the pressure member 331, thereby distancing the knock-up plate 330 from the pickup roller 131. Accordingly, the uppermost or topmost one of the recording media P stacked on the knock-up plate 330 always maintains a contact state with the pickup roller 131.

Figure 3A:
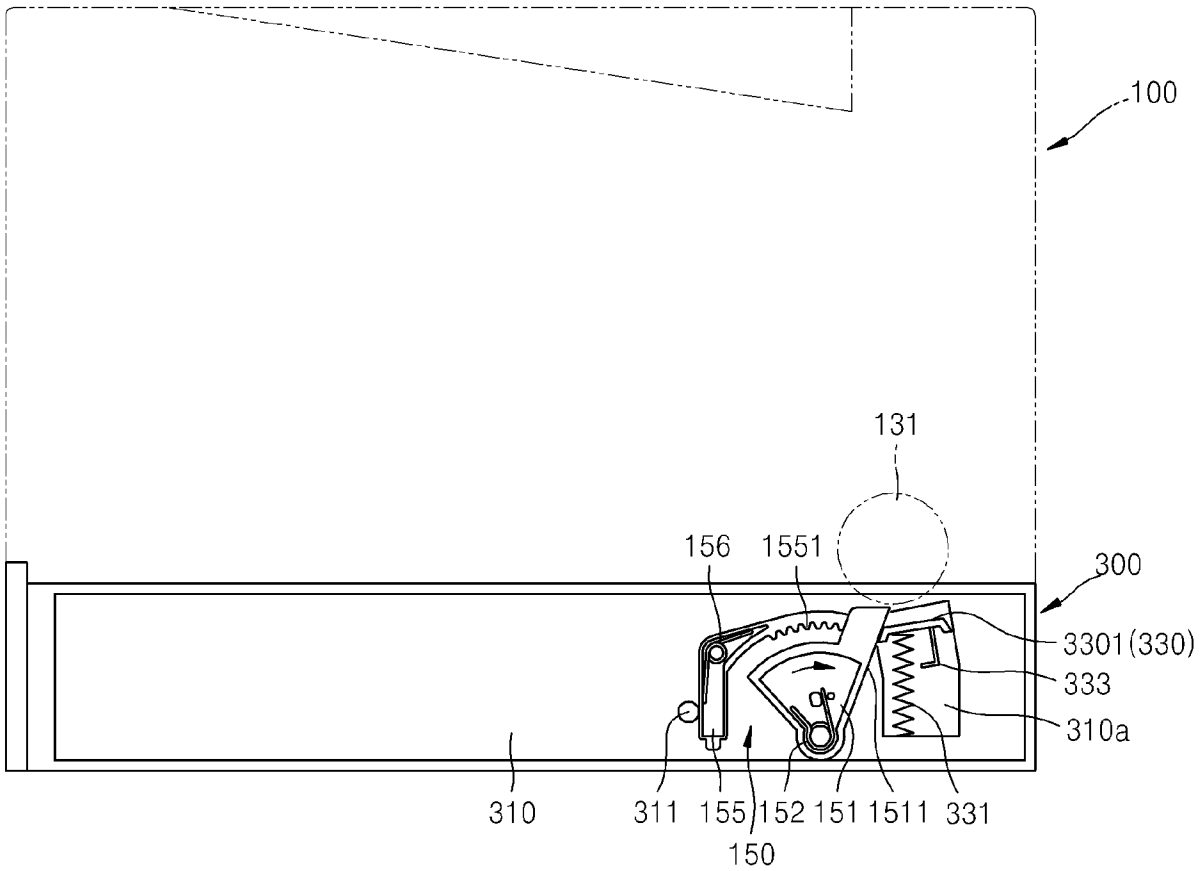
FIG. 3A is a side view of the image forming apparatus according to an embodiment of the present disclosure.
Figure 3B:
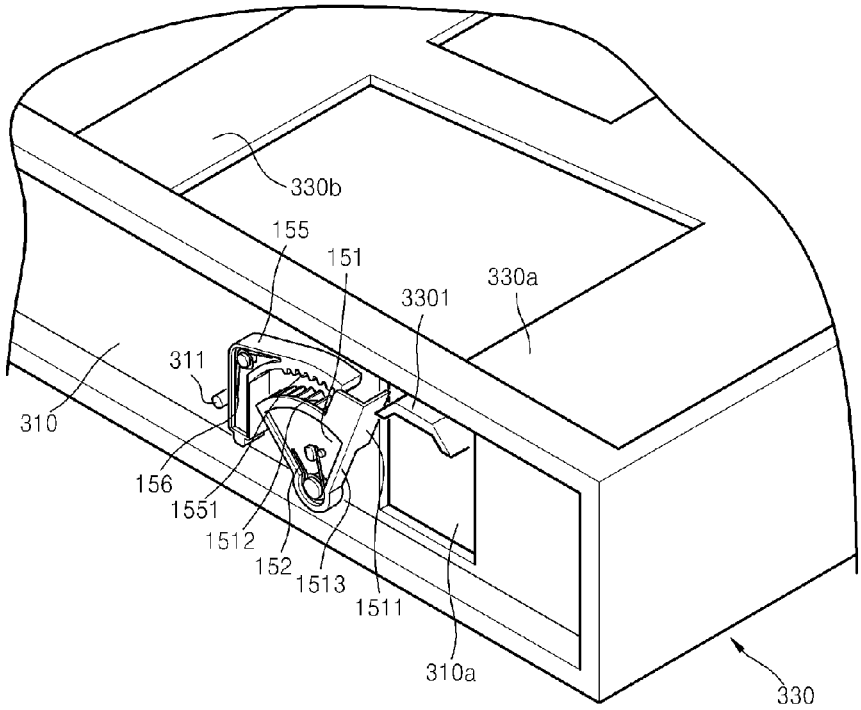
FIG. 3B is a detailed perspective view of a variable guide unit.
Figure 4A:
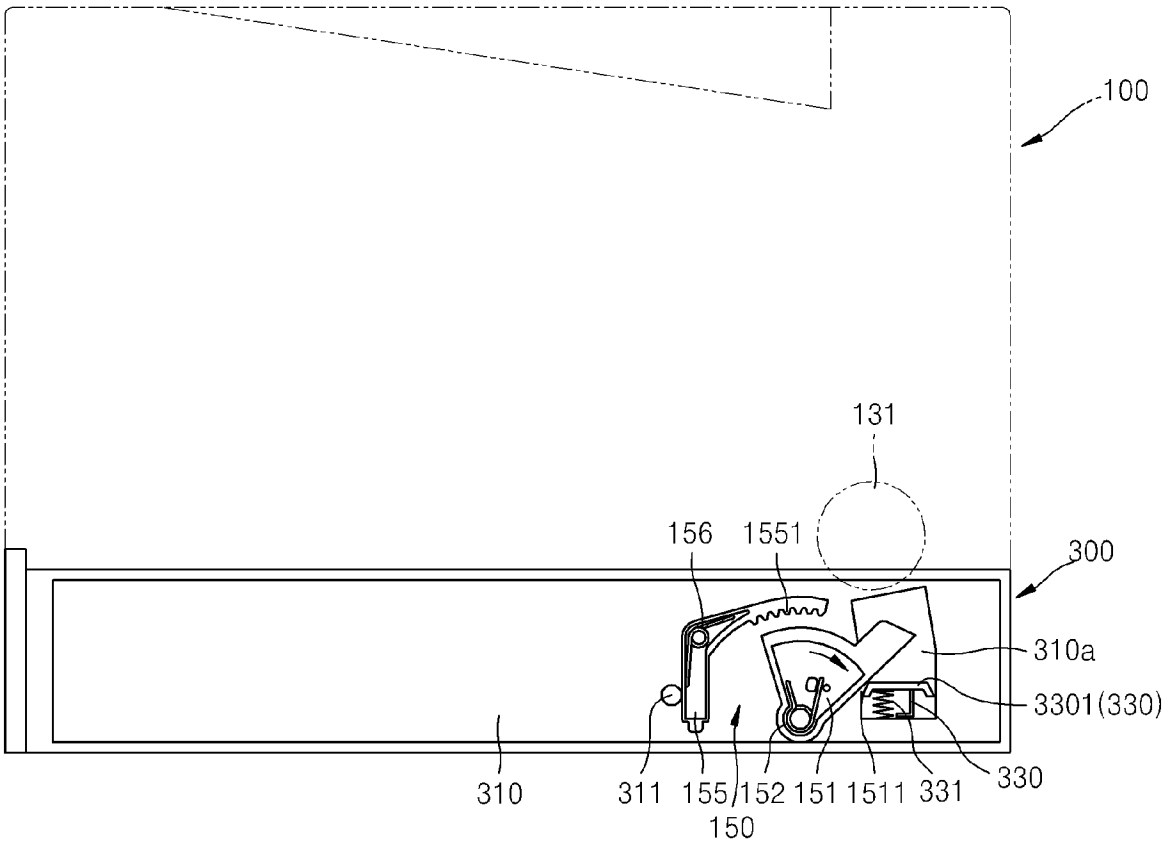
FIG. 4A is a side view of the image forming apparatus to describe an operating state of the variable guide unit when the remaining number of recording media in the paper feeding device is relatively large.
Figure 4B:
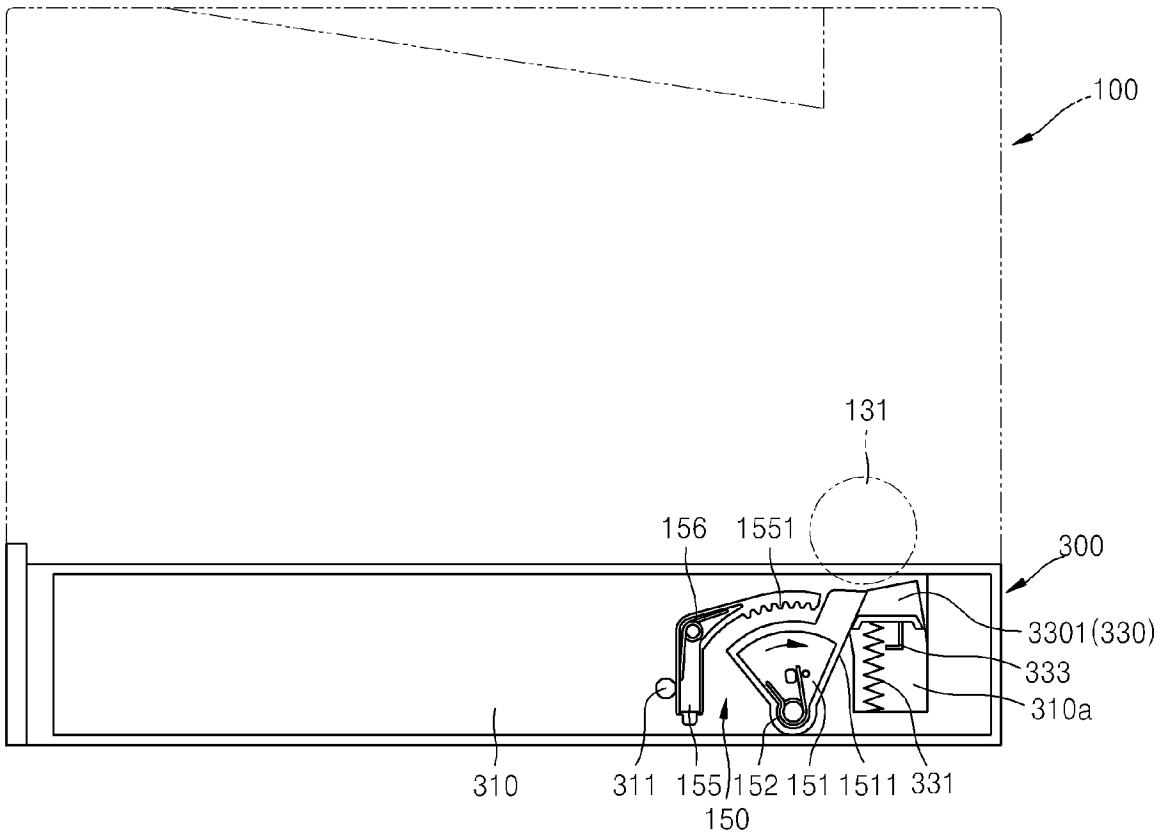
FIG. 4B is a side view of the image forming apparatus to describe an operating state of the variable guide unit when the remaining number of recording media in the paper feeding device is relatively small.

FIG. 2 is a perspective view showing a state in which the paper feeding device 300 is inserted into the main body 100 in the image forming apparatus according to an embodiment of the present disclosure. FIG. 3A is a side view of the image forming apparatus according to an embodiment of the present disclosure. FIG. 3B is a detailed perspective view of the variable guide unit 150. FIG. 4A is a side view of the image forming apparatus to describe an operating state of the variable guide unit 150 when the number of recording media P remaining in the paper feeding device 300 is relatively large, and FIG. 4B is a side view of the image forming apparatus illustrating an operating state of the variable guide unit 150 when the number of recording media P remaining in the paper feeding device 300 is relatively small.

The variable guide unit 150 releases a pressure of the knock-up plate 330 towards the pickup roller 131 by lowering the knock-up plate 330 when the paper feeding device 300 is withdrawn from the main body 100. That is, the variable guide unit 150 moves the recording medium P stacked on the knock-up plate 330 away from the pickup roller 131 by lowering the knock-up plate 330 when the paper feeding device 300 is withdrawn from the main body 100. By doing this, a phenomenon in which the recording medium P stacked on the knock-up plate 330 remains in the main body 100 due to contact with the pickup roller 131 to cause a jam when the paper feeding device 300 is withdrawn from the main body 100 may be prevented.

The variable guide unit 150 may be disposed on an insertion/withdrawal path of the paper feeding device 300 inside the main body 100, as shown in FIG. 2. For example, the variable guide unit 150 may be disposed on one side or on both sides of the insertion/withdrawal path so that the variable guide unit 150 accesses the knock-up plate 330 when the paper feeding device 300 is completely inserted into the main body 100.

The variable guide unit 150 may include, for example, a variable guide member 151 that moves in response to a rising or a lowering, or both, of the knock-up plate 330 and a fixing member 155 for selectively allowing the movement of the variable guide member 151.

Referring to FIGS. 3A and 3B, the variable guide member 151 may be, for example, rotatably assembled with the main body 100. The variable guide member 151 includes a slope unit 1511. The slope unit 1511 is fixed in a slope state based on a withdrawal direction of the paper feeding device 300 so as to lower the knock-up plate in a direction away from the pickup roller when the paper feeding device is being withdrawn from the main body.

The knock-up plate 330 may include a contact unit 3301. The contact unit 3301 may be formed to protrude from the paper feeding cassette 310 through a hole 310*a* formed in a side of the paper feeding cassette 310 by, for example, extending from a side of the front end 330*a* of the knock-up plate 330.

The slope unit 1511 contacts the contact unit 3301. The variable guide member 151 may rotate in a direction of the slope unit 1511 contacting the contact unit 3301 due to gravity. When the knock-up plate 330 rises or lowers according to the effect of gravity on the number of recording media P stacked on the knock-up plate 330, the variable guide member 151 may rotate in response to the rising or lowering of the knock-up plate 330 due to gravity, thereby maintaining a contact state of the slope unit 1511 with the contact unit 3301. The image forming apparatus may further include a first elastic member 152 for providing an elastic force to the variable guide member 151 in a direction in which the slope unit 1511 contacts the contact unit 3301. For example, the first elastic member 152 may be a torsion spring, one end of which is supported by the main body 100 and the other end of which is supported by the variable guide member 151. However, the scope of the present disclosure is not limited thereto, and the first elastic member 152 may employ various elastic members, such as a compression coil spring, a tension coil spring, and a plate spring. The magnitude of the elastic force of the first elastic member 152 is less than the magnitude of the elastic force of the pressure member 331. Not to obstruct rising of the knock-up plate 330, the magnitude of the elastic force of the first elastic member 152 may be set sufficiently smaller than the magnitude of the elastic force of the pressure member 331 within a rotating limitation of the variable guide member 151 to contact the slope unit 1511 with the contact unit 3301.

The variable guide member 151 is biased to rotate in the direction in which the slope unit 1511 contacts the contact unit 3301, by its own weight or the elastic force of the first elastic member 152. When the number of recording media P stacked on the knock-up plate 330 is gradually reduced by performing a printing operation in this biased state, the knock-up plate 330 accordingly rises as shown in FIG. 4B, and the variable guide member 151 accordingly rotates in a counterclockwise direction while maintaining the contact state in which the slope unit 1511 contacts the contact unit 3301. In addition, if additional recording media P are stacked on the knock-up plate 330, the knock-up plate 330 accordingly lowers as shown in FIG. 4A, and the variable guide member 151 accordingly rotates in a clockwise direction by gravity or the elastic force of the first elastic member 152 to maintain the state in which the slope unit 1511 contacts the contact unit 3301. In addition, the slope unit 1511 maintains the slope state based on the withdrawal direction in the states of FIGS. 4A and 4B. That is, the slope unit 1511 maintains the slope state based on the withdrawal direction even in a state in which a maximum number of recording media P are stacked on the knock-up plate 330 and a state in which no recording media P are stacked on the knock-up plate 330.

Referring to FIG. 3B again, when the knock-up plate 330 lowers to some degree with an interference between the slope unit 1511 and the contact unit 3301 in a withdrawal process of the paper feeding device 300, the paper feeding device 300 is completely withdrawn from the main body 100 only if the interference between the slope unit 1511 and the contact unit 3301 is released. To do this, the variable guide member 151 includes a release unit 1513. The release unit 1513 may be formed, for example, by grooving a lower side end of the slope unit 1511. When the contact unit 3301 lowers to some degree by being guided by the slope unit 1511, the contact unit 3301 enters into the release unit 1513, thereby ending the contact between the contact unit 3301 and the slope unit 1511. Then, the paper feeding device 300 can be withdrawn from the main body 100.

Referring to FIGS. 3A and 3B again, the fixing member 155 allows the variable guide member 151 to move according to the rising or lowering of the knock-up plate 330 by being at a release position (refer to FIGS. 3A and 3B) at which the fixing member 155 is released from the variable guide member 151 in a state where the paper feeding device 300 is inserted into the main body 100, and fixes the variable guide member 151 so as not to move by being at a fixing position (refer to FIG. 5B) at which the fixing member 155 is coupled with the variable guide member 151 when the paper feeding device 300 is withdrawn from the main body.

For example, the fixing member 155 is rotatably assembled with the main body 100 to move to the fixing position or the release position. A second elastic member 156 provides an elastic force to the fixing member 155 in a direction in which the fixing member 155 moves to the fixing position. For example, the second elastic member 156 may be a torsion spring, one end of which is supported by the main body 100 and the other end of which is supported by the fixing member 155. However, the scope of the present disclosure is not limited thereto, and the second elastic member 156 may employ various elastic members, such as a compression coil spring, a tension coil spring, and a plate spring.

Switching of the fixing member 155 to the release position may be performed in connection with an insertion process of the paper feeding device 300. The paper feeding cassette 310 may include a switching member 311. For example, as shown in FIG. 3B, the switching member 311 may be formed to protrude from a side of the paper feeding cassette 310. In a state where the paper feeding device 300 is withdrawn from the main body 100, the fixing member 155 is located at the fixing position by the elastic force of the second elastic member 156. When the paper feeding device 300 is inserted into the main body 100, the switching member 311 contacts the fixing member 155 to push the fixing member 155 in a direction against the elastic force of the second elastic member 156. By doing so, the fixing member 155 may switch to the release position. In a state where the paper feeding device 300 is inserted into the main body 100, the switching member 311 maintains a contact state with the fixing member 155, thereby maintaining the fixing member 155 at the release position.

Figure 5A:
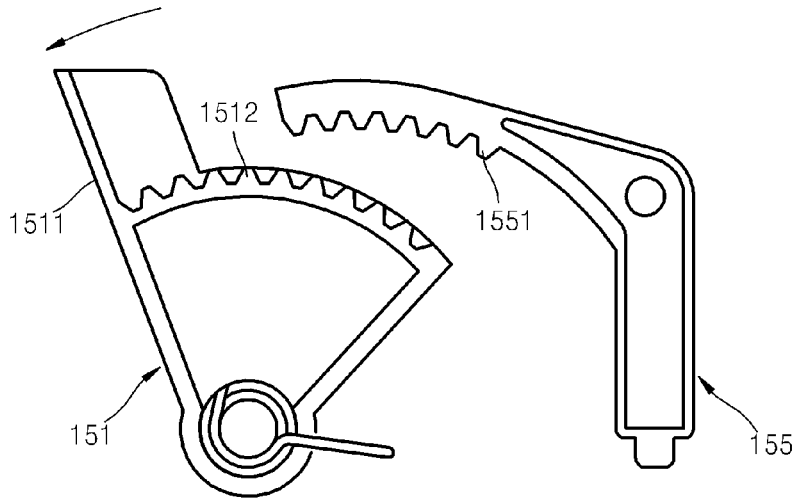
FIGS. 5A and 5B are rear views of the variable guide unit showing a state in which a fixing member is coupled with a variable guide member and released from a variable guide member.
Figure 5B:
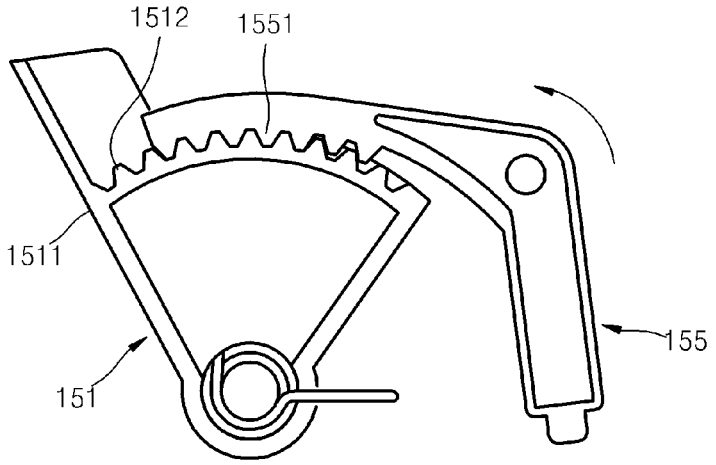

At the fixing position, the fixing member 155 is coupled with the variable guide member 151 to lock the variable guide member 151 so that the variable guide member 151 does not rotate. Referring to FIGS. 3B, 5A, and 5B, the variable guide member 151 includes a first coupling unit 1512, and the fixing member 155 includes a second coupling unit 1551. The first and second coupling units 1512 and 1551 may have complementary shapes. For example, the first and second coupling units 1512 and 1551 may be a protrusion and a groove that can engage with each other, respectively. As shown in FIG. 5A, the first and second coupling units 1512 and 1551 may have gear shapes gearing with each other. By the above-described structure, as shown in FIG. 5B, when the fixing member 155 is located at the fixing position, the first and second coupling units 1512 and 1551 are engaged with each other to maintain the variable guide member 151 in a fixed state so as not to rotate. A position of the variable guide member 151 in relation to the fixing member 155 varies according to the number of recording media P stacked on the knock-up plate 330. In order for the fixing member 155 to easily lock the variable guide member 151 even in this case, the first and second coupling units 1512 and 1551 may have shapes including a plurality of gear teeth.

Figure 6A:
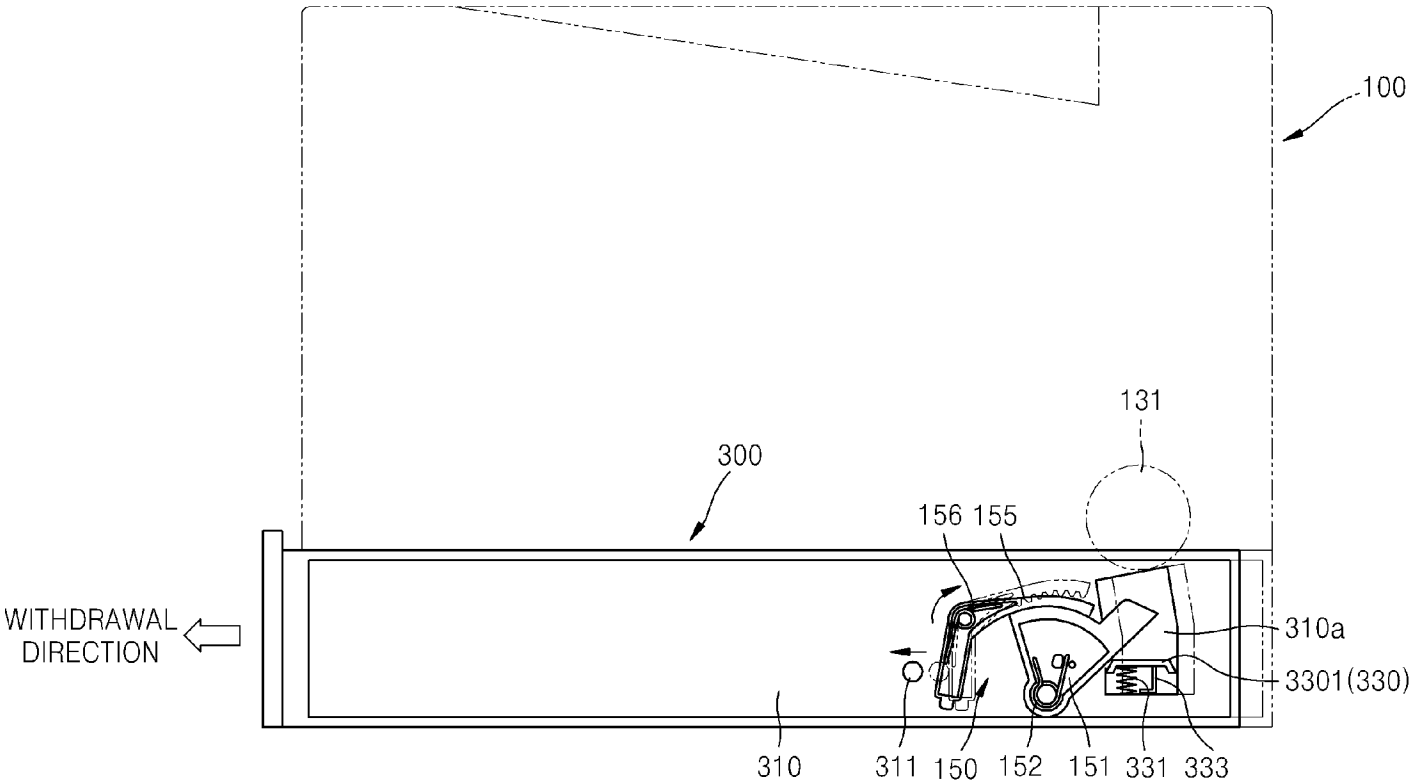
FIGS. 6A and 6B are side views of the image forming apparatus to describe an operating state of the variable guide unit in a process of withdrawing the paper feeding device in a state of the image forming apparatus shown in FIG. 4A.
Figure 6B:
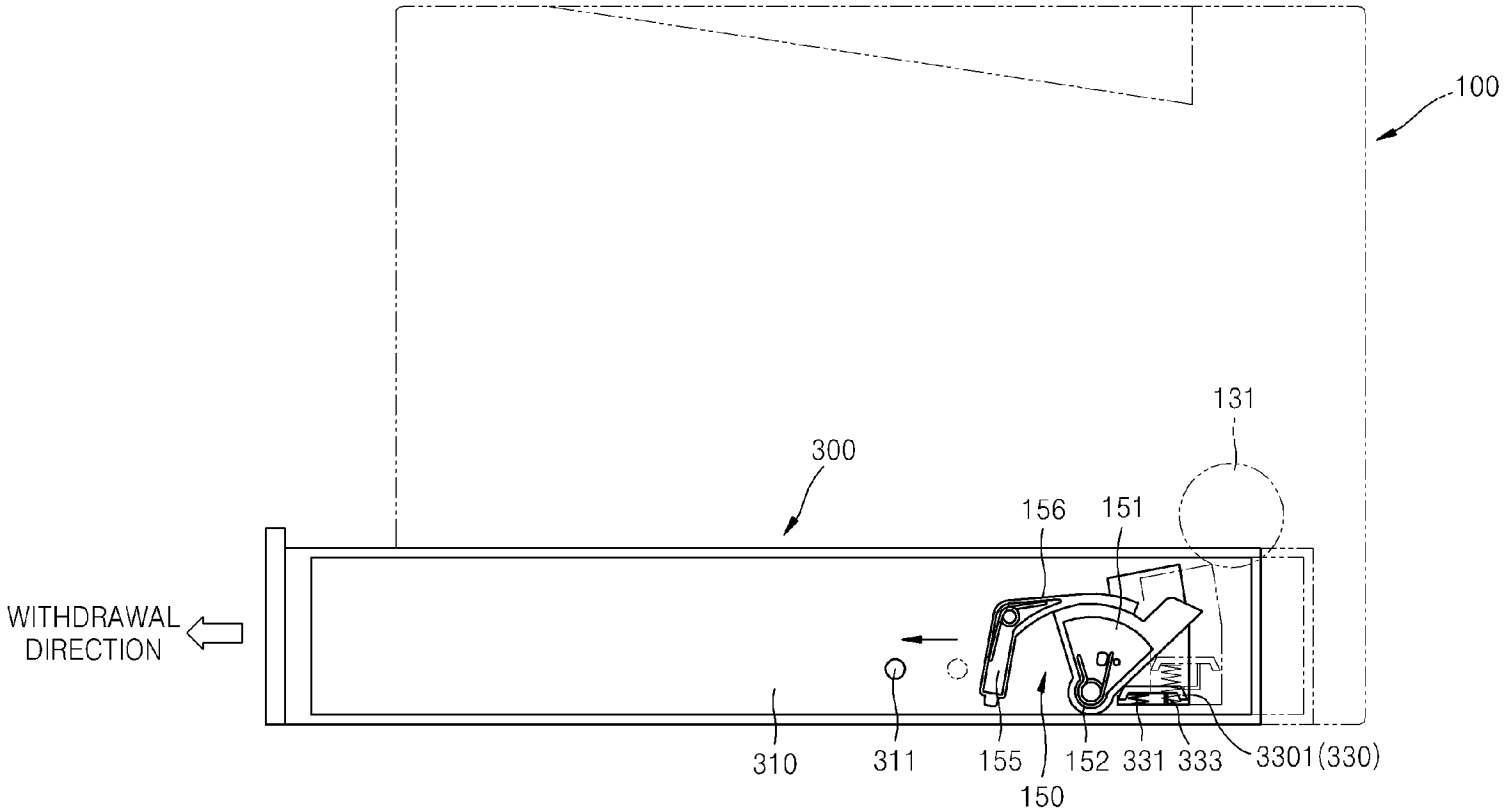

FIGS. 6A and 6B are side views of the image forming apparatus to describe an operating state of the variable guide unit 150 in a withdrawal process of the paper feeding device 300.

Even though the number of recording media P stacked on the knock-up plate 330 varies, the slope unit 1511 of the variable guide member 151 maintains a contact state with the contact unit 3301 of the knock-up plate 330 by its own weight or the elastic force of the first elastic member 152. A process of withdrawing the paper feeding device 300 in this state is described.

FIG. 6A illustrates the image forming apparatus immediately after pulling the paper feeding device 300 to withdraw the paper feeding device 300 from the main body 100. In FIG. 6A, the fixing member 155 and the switching member 311, in a state where the paper feeding device 300 is inserted into the main body 100, are expressed as dotted lines for showing definitely an operating state of a variable guide unit 150. According to the movement of the paper feeding device 300 in a withdrawal direction to some degree in a state where the paper feeding device 300 is inserted into the main body 100, the switching member 311 formed on the paper feeding device 300 also moves in the withdrawal direction. According to the movement of the switching member 311 in the withdrawal direction, the contact between the fixing member 155 and the switching member 311 is released. Accordingly, the fixing member 155 rotates in a direction towards the variable guide member 151 by the elastic force of the second elastic member 156, thereby switching to the fixing position. Then, the first and second coupling units 1512 and 1551 are coupled with each other, and the variable guide member 151 is locked at a fixed position.

FIG. 6B illustrates a state of the image forming apparatus in which the paper feeding device 300 moves further in the withdrawal direction in a locking state of the variable guide member 151. In FIG. 6B, the switching member 311 and contact unit 3301 in a state of FIG. 6A are expressed as dotted lines for showing definitely an operating state of a variable guide unit 150. Referring to FIG. 6B, because the knock-up plate 330 is a member disposed in the paper feeding device 300, the knock-up plate 330 moves according to the movement of the paper feeding device 300. The contact unit 3301 of the knock-up plate 330 contacts the slope unit 1511 of the variable guide member 151. In addition, the variable guide member 151 is locked by the fixing member 155. According to the movement of the paper feeding device 300 in the withdrawal direction, the contact unit 3301 is guided by the slope unit 1511 having a slope lowered in the withdrawal direction, thereby lowering the knock-up plate 330. Then, recording media P stacked on the knock-up plate 330 are separated from the pickup roller 131, thereby releasing the interference between the recording media P and the pickup roller 131.

If the paper feeding device 300 further moves in the withdrawal direction in the interference release state, even though not shown, the contact unit 3301 lowers to some degree by being guided by the slope unit 1511 and enters into the release unit 1513 (refer to FIG. 3B), thereby ending the contact between the contact unit 3301 and the slope unit 1511. Then, the paper feeding device 300 can be withdrawn from the main body 100.

As described above, according to an embodiment of the present disclosure, as soon as the paper feeding device 300 starts to be withdrawn in a state where the slope unit 1511 of the variable guide member 151 contacts the contact unit 3301 of the knock-up plate 330, the variable guide member 151 is locked by the fixing member 155. Accordingly, when the paper feeding device 300 further moves in the withdrawal direction after the locking operation is completed, the knock-up plate 330 lowers due to the relationship between the slope unit 1511 and the contact unit 3301, thereby separating the stacked recording media P from the pickup roller 131. Accordingly, when the paper feeding device 300 is withdrawn, the knock-up plate 330 can lower at the same time as the withdrawal of the paper feeding device 300 regardless of the number of recording media P stacked on the knock-up plate 330, so that a problem in which the recording medium P remains inside the main body 100 due to the interference between the recording media P and the pickup roller 131 during withdrawal of the paper feeding device 300 can be solved.

Although not shown, when the knock-up plate 330 lowers to a predetermined height, the knock-up plate 330 may be fixed to the paper feeding cassette 310 by a hooking member 333 included in the knock-up plate 330. The knock-up plate 330 lowers along the slope unit 1511 contacting with the contact unit 3301 and is fixed at the predetermined height in a process of withdrawing the paper feeding device 300, thereby preventing the knock-up plate 330 from rising even after the knock-up plate 330 passes through the release unit 1513. In addition, because the knock-up plate 330 is fixed to the paper feeding cassette 310 at the predetermined height, the paper feeding device 300 can be inserted again without the knock-up plate 330 being caught by the slope unit 1511.

An image forming apparatus according to an embodiment of the present disclosure may prevent a jam due to a frictional force against a pickup roller by immediately removing a pressure relationship between the pickup roller and a recording medium during withdrawal of a paper feeding device regardless of the remaining number of recording media.

While the present disclosure has been particularly shown and described with reference to exemplary embodiments thereof, they are only illustrative. For example, although an image forming apparatus employing a printing unit for forming a color image by electrophotography using cyan-, magenta-, yellow-, and black-colored toners has been described in the exemplary embodiments, the present disclosure is not limited thereto. The image forming apparatus according to an embodiment of the present disclosure may be applied to image forming apparatuses for forming an image on a recording medium by using various methods, such as a printing unit for forming a single-colored image by electrophotography, a printing unit using ink-jet printing, and a printing unit using thermal transfer printing. Further, it will be understood by those of ordinary skill in the art that various changes in form and details may be made therein without departing from the spirit and scope of the present general inventive concept as defined by the following claims.

What is claimed is:

1. An image forming apparatus comprising:

a main body comprising a printing unit for printing an image on a recording medium and a pickup roller for picking up the recording medium;

a paper feeding device, which comprises an elevatable knock-up plate on which recording media are stackable and a pressure member for elastically pressing the knock-up plate towards the pickup roller, and is removably inserted into the main body; and a variable guide unit, which is supported by the main body, is fixed in a slope state so as to lower the knock-up plate in a direction away from the pickup roller when the paper feeding device is being withdrawn from the main body, and moves to maintain a contact state with the knock-up plate when the paper feeding device is inserted into the main body, wherein the variable guide unit further comprises:

a variable guide member, which has a slope unit downwardly sloped in a withdrawal direction to lower the knock-up plate in a direction away from the pickup roller by contacting a contact unit of the knock-up plate when the paper feeding device is withdrawn form the main body and is supported by the main body for the slope unit to maintain a contact state with the contact unit due to a rising state of the knock-up plate; and a fixing member, which is supported by the main body, the fixing member moving to a fixing position for fixing the variable guide member by coupling with the variable guide member when the paper feeding device is withdrawn from the main body and moving to a release position for releasing the variable guide member by decoupling from the variable guide member when the paper feeding device is inserted into the main body.

2. The image forming apparatus of claim 1, wherein the slope unit comprises a release unit for allowing the contact unit to be released from the slope unit after the knock-up plate is lowered.

3. The image forming apparatus of claim 2, wherein the contact unit is formed to protrude from the knock-up plate, and the release unit is formed as a groove in the slope unit so that the contact unit passes through the release unit.

4. The image forming apparatus of claim 1, further comprising a first elastic member for providing an elastic force to the variable guide member in a direction in which the slope unit contacts the contact unit.

5. The image forming apparatus of claim 4, wherein the elastic force of the first elastic member is less than a pressure exerted by the pressure member.

6. The image forming apparatus of claim 1, further comprising:

a second elastic member for providing an elastic force in a direction in which the fixing member moves to the fixing position; and a switching member for switching to the release position in contact with the fixing member when the paper feeding device is inserted into the main body.

7. The image forming apparatus of claim 6, wherein the switching member maintains the fixing member at the release position by maintaining a contact state with the fixing member in a state in which the insertion of the paper feeding device is completed.

8. The image forming apparatus of claim 1, wherein the variable guide unit comprises a first coupling unit, and the fixing member comprises a second coupling unit having a shape complementary to the first coupling unit, the second coupling unit being coupled with the first coupling unit when the fixing member is located at the fixing position.

9. The image forming apparatus of claim 8, wherein the first and second coupling units have gear shapes that gear with each other.

* * * * *

UNITED STATES PATENT AND TRADEMARK OFFICE

CERTIFICATE OF CORRECTION

PATENT NO. : 8,910,933 B2
APPLICATION NO. : 13/665050
DATED : December 16, 2014
INVENTOR(S) : Dong-hyup Shin It is certified that error appears in the above-identified patent and that said Letters Patent is hereby corrected as shown below:

In the Claims

Claim 1, Column 10, Line 38:

Delete “form” and insert --from--, therefor.

Signed and Sealed this
Thirtieth Day of June, 2015

Michelle K. Lee

Michelle K. Lee
*Director of the United States Patent and Trademark Office*